United States Patent [19]

Sato

[11] Patent Number: 4,633,674

[45] Date of Patent: Jan. 6, 1987

[54] REFRIGERATION CIRCUIT

[75] Inventor: Motoharu Sato, Honjo, Japan

[73] Assignee: Sanden Corporation, Japan

[21] Appl. No.: 731,353

[22] Filed: May 7, 1985

[30] Foreign Application Priority Data

May 7, 1984 [JP] Japan ..... 59-65490[U]

[51] Int. Cl.[4] ..... F25B 41/06

[52] U.S. Cl. ..... 62/197; 62/117; 62/205; 62/323.4

[58] Field of Search ..... 62/196.1, 197, 117, 62/323.4, 205

[56] References Cited

U.S. PATENT DOCUMENTS

| | | | |
|---|---|---|---|
| 3,564,865 | 2/1971 | Spencer et al. | 62/197 |
| 4,084,405 | 4/1978 | Schibbye et al. | 62/197 |
| 4,499,739 | 2/1985 | Matsuoka et al. | 62/197 X |
| 4,517,811 | 5/1985 | Atsumi et al. | 62/197 |

FOREIGN PATENT DOCUMENTS

| | | | |
|---|---|---|---|
| 31249 | 3/1978 | Japan | 62/197 |
| 125560 | 9/1979 | Japan | 62/197 |

*Primary Examiner*—Albert J. Makay
*Assistant Examiner*—Steven E. Warner
*Attorney, Agent, or Firm*—Banner, Birch, McKie & Beckett

[57] ABSTRACT

The invention relates to a refrigeration circuit which includes a second expansion means and a flow self-operated regulating valve, which controls the quantity of refrigerant to an intermediate suction port of compressor depending on a difference of pressure at the side of inlet from at the side of outlet of the expansion capillary.

3 Claims, 6 Drawing Figures

REFRIGERATION CIRCUIT

TECHNICAL FIELD

The invention relates to a refrigeration circuit, for the compression, the condensation, the expansion and the evaporation of refrigerant. Particularly, the invention relates to a refrigeration circuit for an automotive air conditioner.

BACKGROUND OF THE INVENTION

Referring to FIG. 1, a typical, known refrigeration circuit for an automobile air conditioner comprises a compressor 1 driven by the automobile engine, a condenser 2, an expansion valve 4 (the first means of expansion) and an evaporator 5. In standard operating fashion, the refrigerant discharged from compressor 1 passes respectively, through condenser 2, expansion valve 4 and evaporator 5, and returns to the inlet port of compressor 1. The refrigerant causes evaporator 5 to absorb surrounding heat and to control air conditioning in the inside of a car. In the refrigeration circuit in FIG. 1, a receiver-dryer 3 may be placed between condenser 2 and expansion valve 4, although it is not always needed. Receiver-dryer 3 functions to absorb water in the refrigerant. Receiver-dryer 3 also may reduce the excess refrigerant, increase the lack of refrigerant and thus improve the efficiency of the refrigeration circuit according to changes of the air conditioning load.

In the above-mentioned refrigeration circuit, the operation of compressor 1 is controlled by an electromagnetic clutch (not shown). Engagement of the electromagnetic clutch is controlled according to a temperature-detector, for example, a thermostat. However, when the electromagnetic clutch is engaged, there is a significant change of torque in compressor 1 which places a drag on the automobile engine, hindering performance and driveability. Additionally, with conventional air conditioning systems, when a car is driven at high speed with a heavy air conditioning load, the temperature of refrigerant discharged from compressor 1 may become too high, which adversely affects both the durability of compressor 1 and the rubber hoses on compressor 1.

SUMMARY OF THE INVENTION

It is an object of the invention to provide an improved engine driven refrigeration circuit, in which starting the compressor or engaging an electromagnetic clutch, does not adversely affect engine performance on the cooling system.

It is another object of the invention to provide an improved refrigeration circuit which can prevent the refrigerant discharged from the compressor from getting too hot during periods of high loads.

The present invention is directed to a refrigeration circuit. The refrigeration circuit includes a compressor, a condenser, an expansion capillary, a receiver-dryer, an expansion valve, a flow self-operated regulating valve and an evaporator. The compressor is coupled to the expansion capillary through the condenser, and the expansion capillary is coupled to the expansion valve through the receiver-dryer. The expansion valve is coupled to the suction port of the compressor through the evaporator. The receiver-dryer is coupled to an intermediate suction port of the compressor through the regulating valve. The regulating valve controls the quantity of refrigerant which passes from the receiver-dryer to the intermediate suction port of the compressor, as a function of the difference of the pressure at the side of inlet from that at the side of outlet of the expansion capillary.

Further objects, features and other aspects of this invention will be understood from the following detailed description of the preferred embodiments of this invention referring to the attached drawings.

DETAILED DESCRIPTION

Figure 2:
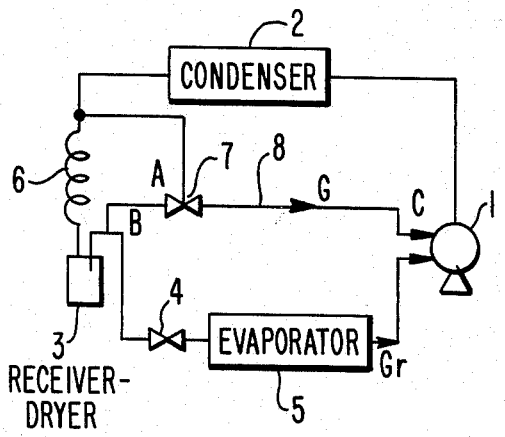
FIG. 2 is a view of a refrigeration circuit illustrating an embodiment of the invention.

Referring to the attached drawings in FIG. 2, there is shown a refrigeration circuit particularly adapted for an automobile air conditioner, although other uses will be apparent. The refrigeration circuit of the present invention preferably comprises a compressor 1, a condenser 2, a receiver-dryer 3, an expansion valve 4, an evaporator 5, an expansion capillary 6 and a self-operated regulating valve 7. Condenser 2 is connected to the outlet port of compressor 1 and also coupled to rceiver-dryer 3 through expansion capillary 6. Receiver-dryer 3 is coupled to evaporator 5 through expansion valve 4, and evaporator 5 is connected to the inlet port of compressor 1. The inlet port A of regulating valve 7 is connected to the inlet port of expansion capillary 6. The inlet port B of regulating valve 7 is connected to the outlet port of receiver-dryer 3. The outlet portion of regulating valve 7 is coupled to an intermediate suction port C of compressor 1 through refrigerant conduit 8 shown in FIG. 2, so that refrigerant may flow directly from receiver-dryer 3 to compressor 1.

Regulating valve 7 controls the quantity of refrigerant from receiver-dryer 3 to intermediate suction port C depending on the difference P between the refrigerant pressure at the inlet port of expansion capillary 6 and the refrigerant pressure at the outlet portion of receiver-dryer 3. When the pressure at the inlet port of expansion capillary 6 is greater than the pressure at the outlet port or receiver-dryer 3, valve 7 is opened which permits refrigerant to flow through conduit 8. Preferably valve 7 is a spring biased, diaphragm type flow valve. Thus, the larger the pressure differential P, the greater the flow through valve 7 and conduit 8.

Figure 3:
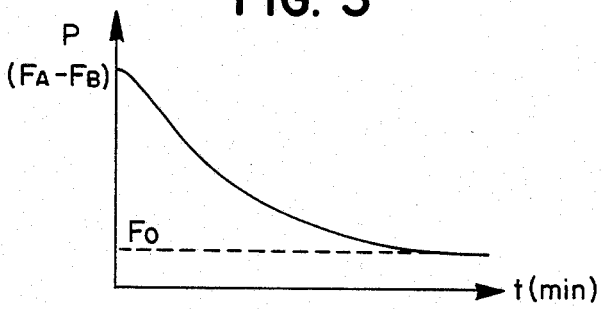
FIG. 3 is a graph illustrating the difference between pressure (Fa) at one side of the self-operated regulating valve in the refrigeration circuit of the present invention and pressure (Fb) at the other side of the self-operated regulating valve versus time.

Referring to FIG. 3, there is shown the difference (P) between the pressure Fa at the inlet port A of regulating valve 7 and pressure Fb at the inlet port B of regulating valve 7. Fo is the steady state value of the difference between force Fa and Fb.

Since the pressure differential P is very large when compressor 1 is started, at start-up valve 7 will be opened widely so that a large quantity of refrigerant flows through refrigerant conduit 8. As the pressure differential P decreases with time and the refrigeration circuit approaches its steady state (Fo), the quantity of refrigerant that flows in conduit 8 gradually decreases. As refrigerant is supplied from conduit 8 to intermediate suction port C, the system reaches its steady state operation much sooner than with the conventional circuit shown in FIG. 1 (see FIG. 6). Thus, the torque produced when compressor 1 is started (for example, when an electromagnetic clutch (not shown) controlling compressor 1 is engaged) is reduced significantly, which reduces the shock to the driving system.

Figure 4:
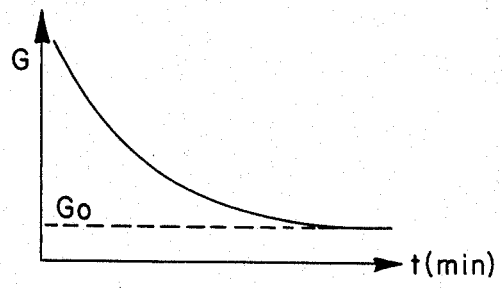
FIG. 4 is a graph illustrating the refrigerant circulating weight G per unit time which passes between the regulating valve and the compressor.

Shown in FIG. 4 is the characteristic of refrigerant circulating weight or volume G per unit time which passes through refrigerant conduit 8. Go is the steady state value of G. As the pressure differential P decreases, the flow of refrigerant through conduit decreases correspondingly, with a resultant decrease in the weight of volume of refrigerant G flowing through conduit 8.

Figure 5:
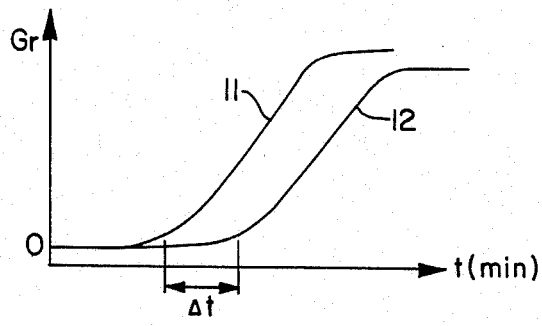
FIG. 5 is a graph illustrating the refrigerant circulating weight Gr per unit time which passes through the evaporator in the circuits shown in FIGS. 1 and 2.

FIG. 5 illustrates the refrigerant circulating weight or volume Gr per unit time which passes through evaporator of the refrigeration circuit. Curve 11 shown in FIG. 5 indicates the characteristic Gr of the refrigeration circuit in FIG. 1. Curve 11 illustrates the performance characteristics of the circuit of the present invention shown in FIG. 2. When the refrigerant circulating volume Gr for the refrigerant circuit in FIG. 2 is compared with the refrigerant circulating volume Gr for the refrigeration circuit in FIG. 1, it is observed that the refrigerant circulating volumes are substantially identical. However, the circuit of the present invention, shown by curve 12, achieves a full, steady state flow through evaporator 5 at a later time t than the circuit in FIG. 1, shown by curve 11, as a result of the fact that part of the refrigerant is diverted through conduit 8.

Figure 6:
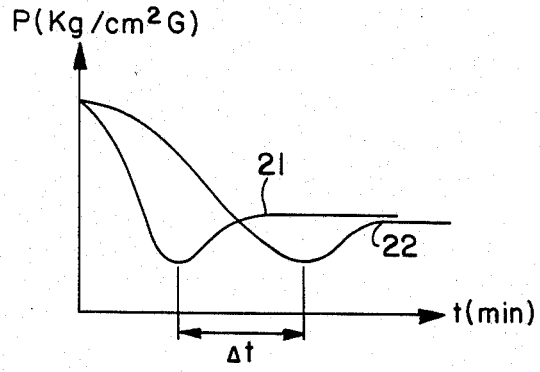
FIG. 6 is a graph illustrating the pressure variation at the inlet side of the compressor in the circuits shown in FIGS. 1 and 2.

Shown in FIG. 6 is the variation at the refrigerant inlet of compressor 1. Curve 22 indicates the characteristic of the pressure in the refrigeration circuit shown in FIG. 1. Curve 21 indicates the characteristic of the pressure in the refrigeration circuit shown in FIG. 2. When the pressure in the refrigeration circuit shown in FIG. 2 is compared with the pressure in the refrigerant circuit shown in FIG. 1, it is noted that although the pressure in the refrigeration circuit shown in FIG. 2 reaches substantially the same low pressure point as the pressure in the refrigeration circuit shown in FIG. 1, the FIG. 2 circuit achieves the low pressure point at a time t earlier than the FIG. 1 circuit. Thus, the torque on compressor 1 can be reduced significantly and early in the cycle.

Figure 1:
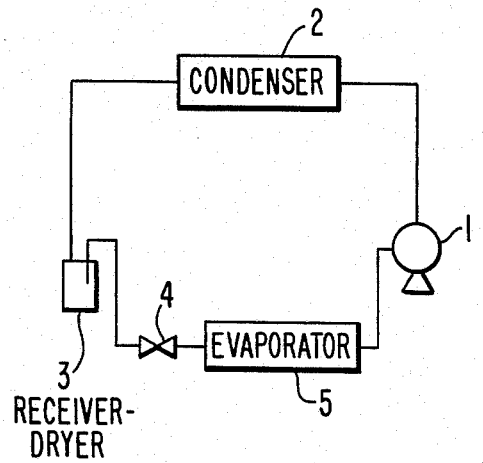
FIG. 1 PRIOR ART
FIG. 1 is a view of a conventional, known refrigeration circuit.

The quantity of refrigerant which is controlled by regulating valve 7 is conveyed into compressor 1 through refrigerant conduit 8, after compressor 1 is started the temperature of discharging refrigerant from compressor 1 can be prevented from unusual increasing, which is produced in the refrigeration circuit in FIG. 1. In order to decrease the temperature of discharging refrigerant from compressor 1, it is effective to flow the refrigerant which is in a high ratio to liquid to refrigerant route 8 in FIG. 2.

The circuit shown in FIG. 2 may be modified by deleting the receiver-dryer 3 from the circuit. In this case, the outlet portion of expansion capillary 6 can be connected directly to the inlet portion of expansion valve 4 and the inlet port B of regulating valve 7.

This invention has been described in detal in connection with the preferred embodiment but these are examples only and the invention is not restricted thereto. It will be easily understood, by those skilled in the art that other variations and modifications can be easily made within the scope of this invention.

I claim:

1. In a refrigerant circuit including a compressor, a condenser, a first expansion means and an evaporator so that discharging refrigerant from a compressor passes through said condenser, said first expansion means and said evaporator, respectively, and returns to a first suction port of said compressor, the improvement comprising:

a second expansion means connecting said condenser and said first expansion means so that the outlet port of said second expansion means is connected to the inlet port of said first expansion means; and a pressure sensitive regulating valve fixed between an inlet port of said second expansion means and an outlet port of said second expansion means so that said valve is responsive to a pressure differential between said inlet and outlet ports whereby said valve opens progressively wider as the pressure differential increases, the outlet port of said valve connected to a second suction port of said compressor so that said valve controls the quantity of refrigerant passing from said second expansion means to said second suction port of said compressor according to the pressure differential between said inlet and outlet ports of said second expansion means, said pressure differential and thus said quantity of refrigerant being larger when said compressor is engaged and thereafter diminishing so that the torque produced when said compressor is engaged is reduced while steady-state flow through the circuit is quickly attached.

2. A refrigerant circuit as recited in claim 1 wherein said first expansion means comprises an expansion valve and said second expansion means comprises an expansion capillary.

3. In a refrigerant circuit including a compressor, a condenser, a first expansion means and an evaporator so that discharging refrigerant from a compressor passes through said condenser, said first expansion means and said evaporator, respectively, and returns to a first suction port of said compressor, the improvement comprising:

a second expansion means and a receiver-dryer in the circuit, said second expansion means fixed between an outlet port of said condenser and an inlet port of said receiver-dryer, said receiver dryer fixed between an outlet port of said second expansion means and said first expansion means;

a pressure sensitive regulating valve connecting an inlet port of said second expansion means and an outlet port of said receiver-dryer so that said valve is responsive to a pressure differential between said inlet port of said second expansion means and the outlet port of said receiver-dryer whereby said valve opens progressively wider as the pressure differential increases, the outlet port of said valve connected to a second suction port of said compressor so that said valve controls the quantity of refrigerant passing from said receiver-dryer to said second suction port of said compressor according to the pressure differential the pressure differential and thus said quantity of refrigerant being larger when said compressor is engaged and thereafter diminishing so that the torque produced when said compressor is engaged is reduced.

* * * * *